United States Patent [19]

Bukala

[11] 4,195,285

[45] Mar. 25, 1980

[54] DOUBLE BUZZER ASSEMBLY

[75] Inventor: Alexander E. Bukala, Chicago, Ill.

[73] Assignee: Littelfuse, Inc., Des Plaines, Ill.

[21] Appl. No.: 965,272

[22] Filed: Dec. 1, 1978

[51] Int. Cl.[2] ..... G08B 3/00

[52] U.S. Cl. ..... 340/402; 340/52 F

[58] Field of Search ..... 340/402, 326, 52 R, 340/52 F

[56] References Cited

U.S. PATENT DOCUMENTS 3,810,149 5/1974 Miller ..... 340/326

*Primary Examiner*—Harold I. Pitts

*Attorney, Agent, or Firm*—Wallenstein, Spangenberg, Hattis & Strampel

[57] ABSTRACT

A double buzzer assembly comprises a housing assembly including a main housing body having a parts-receiving opening confronted by a cover removably interlocked with said main body portion and first and second buzzer units mounted in said main body portion in spaced relation in a direction parallel to the plane of the opening and adjacent to a rear sound emitting wall on the opposite side of the main housing body from said opening. A heater coil and terminal-carrying sub-assembly is mounted in guideways in the main housing body which guideways open onto the parts-receiving opening, the sub-assembly including a support member carrying a heater coil for one of the buzzer units and contacts in series with one of the buzzer units which contacts open after the heater has been energized for a given period of time, and respective terminals projecting through apertures in the main housing body and making electrical connection separately with the buzzer units to enable the buzzer units to be energized from separate ones of said terminals, and the heater coil to become energized with one of the buzzer units.

25 Claims, 12 Drawing Figures

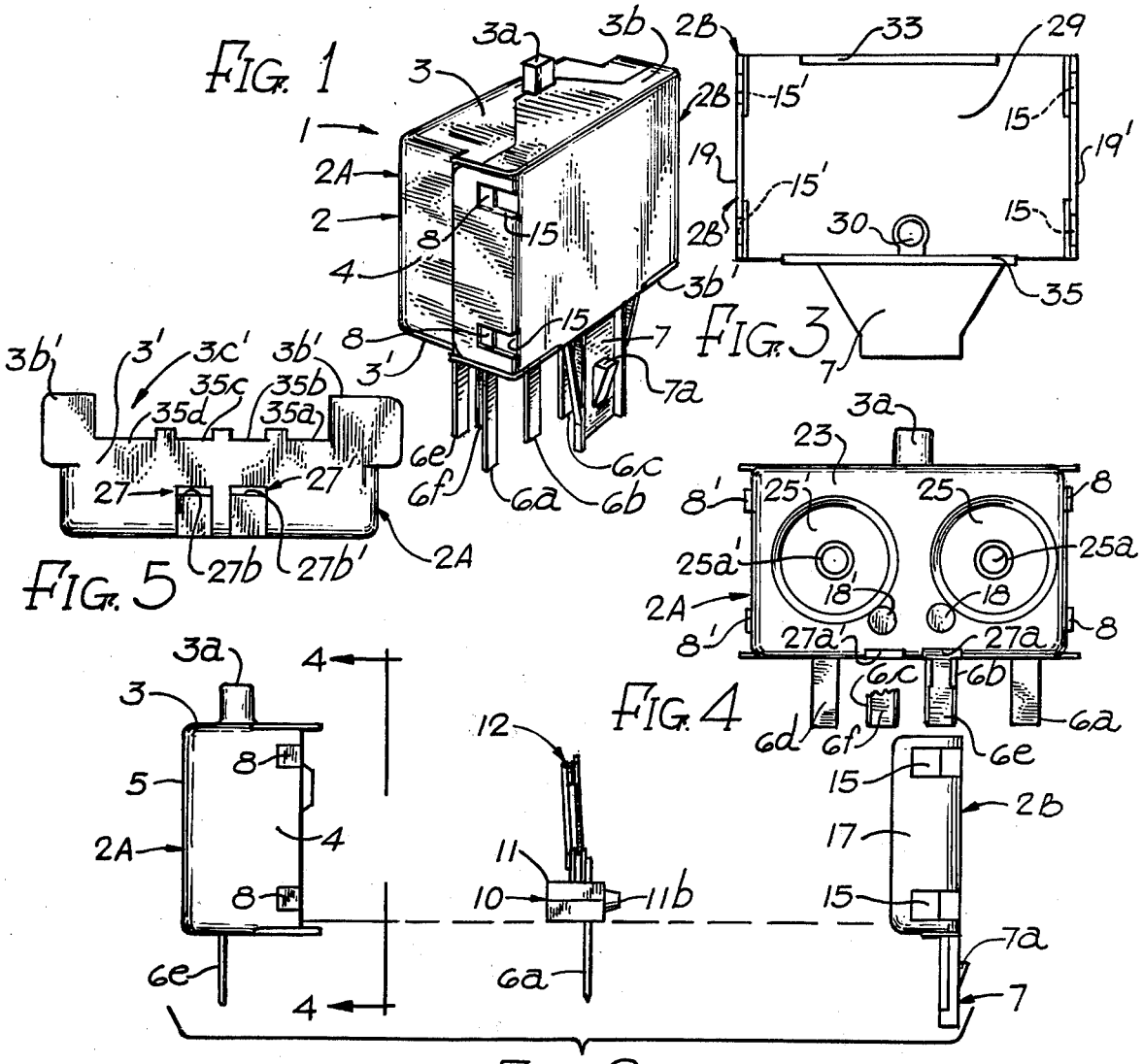
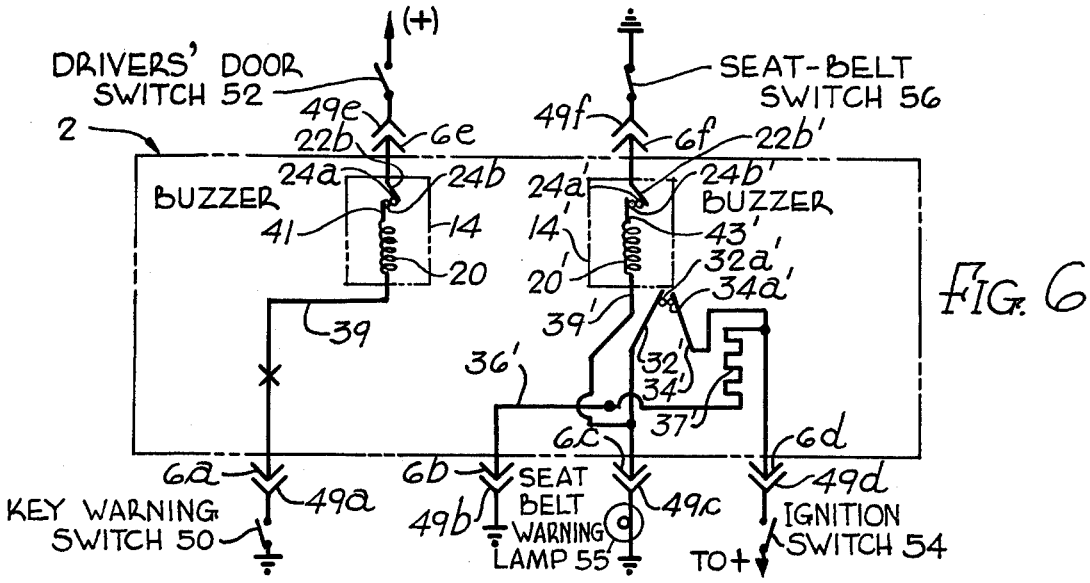
FIG. 6

DOUBLE BUZZER ASSEMBLY

BACKGROUND OF THE INVENTION

This invention relates to audio signalling devices, generally referred to as buzzers, having use, for example, in automobiles to signal a warning to the driver when he opens the front door of the automobile without removing his keys from the ignition and to signal at least a temporary warning when the driver of the automobile fails to connect his seat belt. In the past, these two types of buzzers were mounted in completely separate housings, in turn, mounted in separate receiving sockets attached to connecting harnesses. The present invention combines these two types of buzzer units in a common housing assembly and in a manner which minimizes the cost of manufacture thereof and reduces the overall size of the buzzer assembly.

SUMMARY OF THE INVENTION

The various component parts of the double buzzer assembly of the invention are uniquely located and supported in a main housing body having a front parts-receiving opening confronted by a cover removably interlocked with the main housing body. The buzzer units are spaced apart in a direction parallel to the plane of the parts-receiving opening of the main housing body and adjacent to the rear wall of the main body portion of the housing which preferably acts as a sound emitting wall to be struck by the striker-carrying end of the buzzer armatures. This sound emitting wall is preferably thinned in regions opposite the associated buzzer units so that these portions of the sound emitting wall are independently vibratable.

Contributing to the low cost, ease of assembly and compactness of the double buzzer assembly of the invention is the provision of a terminal-carrying sub-assembly mounted in the main housing body preferably in guideways opening onto the parts-receiving opening of the main housing body, so that the subassembly is slid into place after the buzzer units are anchored by rivets or the like next to the rear wall of the main housing body, and then held in place by the cover which preferably snap-fits over the open front side of the main housing body. The subassembly extends in the direction in which the buzzer units are spaced apart so that these terminals are located opposite their associated buzzer units, to reduce the length of the conductors connecting the same to the buzzer unit components. This subassembly comprises a common insulating support base from which projects on opposite sides thereof, in a direction parallel to the plane of the parts-receiving opening of the main housing body and transversely to the spacing direction of the buzzer units, conductive projections which form at least some of the plug-in terminals for both buzzer units outside of the housing body, and timer part supports and at least some of the conductor-receiving terminals for both buzzer units on the inside of the main housing body.

Where a timer is associated with one of the buzzer units, such as an old and well-known type comprising a pair of bimetal blades and a heater coil wound around one of the blades, the terminal-carrying sub-assembly carries the same. In such case, the bimetallic blades are supported on a pair of extensions of the sub-assembly plug-in terminals. The bimetal blades respectively carry normally-closed contacts connected in series with the adjacent buzzer unit, the contacts separating when the heat from the heater coil causes the blades to deflect after a given time period.

By placing all of the components forming the two buzzer units in a common housing pluggable into a common harness socket and by utilizing a common terminal and timer carrying sub-assembly for both buzzer units as described, the manufacturing and installation costs and mounting space required is much less than that for the separate buzzer assemblies heretofore utilized for the same purpose.

While a single buzzer assembly including a buzzer unit and a timer of the kind described forming a single operating circuit and mounted on a common support base is old in the art (see U.S. Pat. No. 4,003,043), the present invention materially differs from this assembly in that, among other reasons, it combines two separate electrical devices, preferably two separately controllable buzzer units and an associated timer for at least one of the same, in a common housing where the buzzer units are separately mounted on a main housing body also containing a separate timer and terminal-carrying sub-assembly. Also, while a single buzzer assembly including a timer like that described has been heretofore marketed which utilized a separate timer and terminal-carrying sub-assembly, the sub-assembly did not include terminals for a second buzzer unit and the sub-assembly was not slidably supported in guideways or located between the associated buzzer unit and a cover for the main housing body, as in the case of the most advantageous form of the present invention.

Other features of the invention deal with particular details of the main housing body to be described and claimed. Thus, the above and other advantages and features of the invention will become apparent upon making reference to the specification to follow, the claims and the drawings.

DESCRIPTION OF DRAWINGS

FIG. 1 is a perspective view of a double buzzer assembly constituting the most preferred form of the present invention;

FIG. 2 is an exploded view showing the three basic components of the buzzer assembly shown in FIG. 1, namely a main body portion with buzzer units mounted therein, a timer and terminal carrying sub-assembly and a cover;

FIG. 3 is a view of the inside of the cover shown in FIGS. 1 and 2;

FIG. 4 is a view of the rear of the main housing body portion of the housing assembly shown in FIG. 1;

FIG. 5 is a bottom view of the main housing body portion of the housing assembly shown in FIG. 1 before any other parts have been mounted therein or attached thereto;

FIG. 6 is a circuit diagram of the components making up the electrical portions of the double buzzer assembly of the invention shown in FIGS. 1 and 2;

DESCRIPTION OF EXEMPLARY EMBODIMENT OF THE INVENTION

Figures 7, 8, 9, 10, 11, 12:
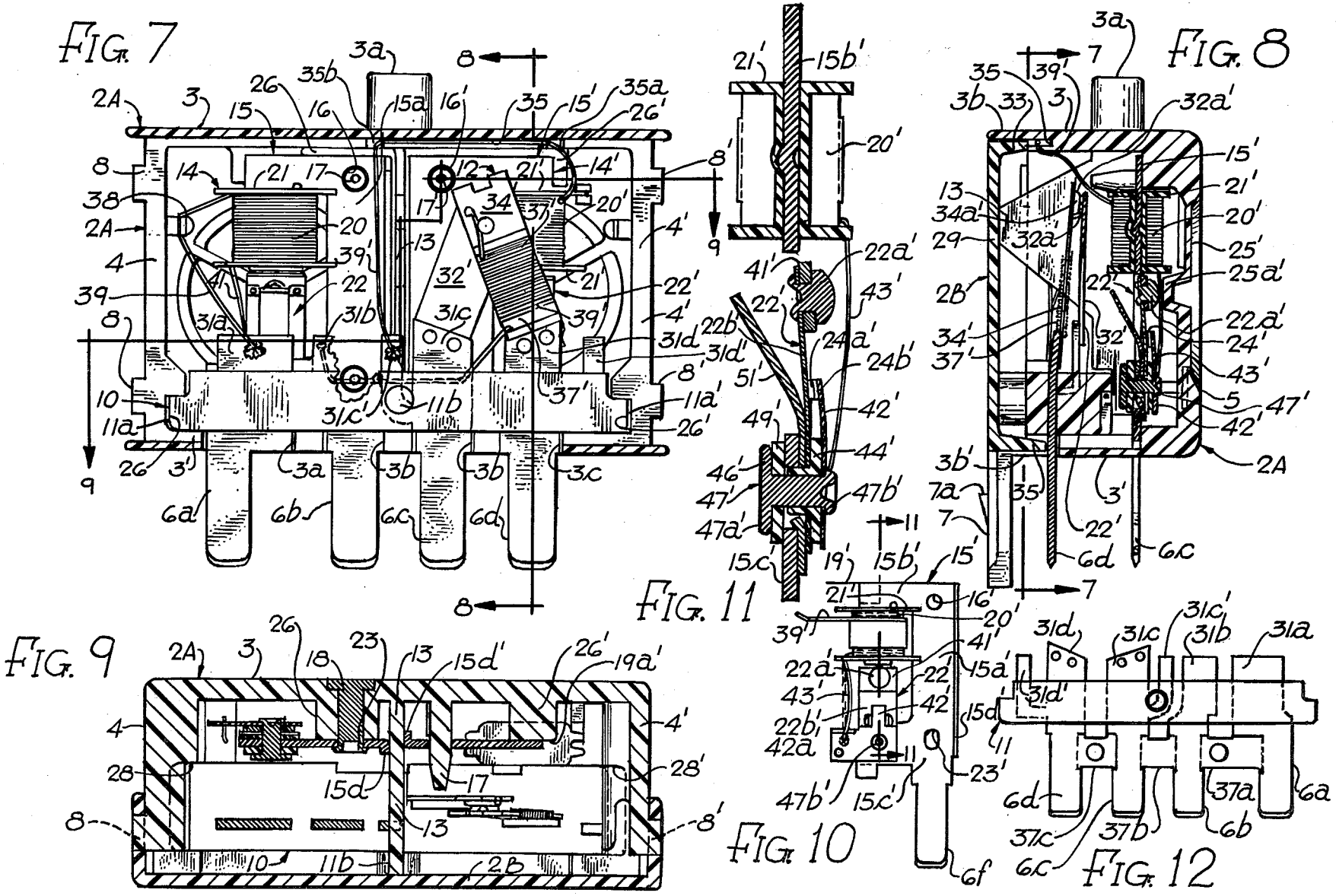
FIG. 7 is an enlarged longitudinal vertical sectional view through the double buzzer assembly of the invention, taken in a longitudinal plane represented by section lines 7—7 in FIG. 8.
FIG. 8 is a transverse vertical sectional view of the double buzzer assembly shown in FIG. 8, taken along section line 8—8 therein.
FIG. 9 is a longitudinal horizontal sectional view through the double buzzer assembly shown in FIG. 8, taken along irregular section lines 9—9 therein.
FIG. 10 is an elevational view of the right-hand buzzer unit shown in FIG. 6, as seen from the rear thereof.
FIG. 11 is an enlarged vertical sectional view through the buzzer unit shown in FIG. 10, taken along section line 11—11 therein.
FIG. 12 shows the insulating support base and the various terminals of the timer and terminal-carrying sub-assembly when the insulating support base and the terminals are removed from a mold, there being connecting webs to be severed extending between the terminals previously formed by stamping the same from a common piece of sheet metal.

The double buzzer assembly shown in the drawings and generally identified by reference numeral 1 includes a housing assembly comprising a main housing body 2A and a cover 2B. The main housing body has a generally rectangular configuration and, assuming the orientation there shown, includes top and bottom walls 3–3', vertical side walls 4–4' and a rear sound-emitting wall 5. The top and side walls 3–3' and 4–4' define on the front side of the main housing body a parts-receiving opening which is enclosed by a cover 2B. A harness socket-receiving wall 7 having a locking projection **7*a* extends downwardly from the bottom of the cover 2B, and a mounting projection 3*a* extends upwardly from the top wall 3 of the main housing body 2A. These mounting elements 3*a* and 7*a* are conventional in housings for mounting buzzers in automobiles, so that their exact relationship with the receiving components therefor need not now be described. Ribs 8–8' project outwardly from the side walls 4–4' of the main housing body 2A and receive in snap-on relationship the defining walls of apertures 15–15' formed in rearwardly extending side walls 19–19' of the cover 2B**.

Projecting downwardly from the front of the main housing body 2A are plug-in terminals **6*a*, 6*b*, 6*c*, and 6*d*, the terminal 6*a* being associated with one buzzer unit 14 within the main housing body 2A and the plug-in terminals 6*b* 6*c*, and 6*d* being associated with the other buzzer unit 14' within the main housing body. Projecting downwardly from the rear portion of the main housing body are plug-in terminals 6*e*–6*f* respectively forming integral portions of the buzzer units 14–14' to be described, one of which is shown in its entirety in FIG. 10 to be described. The terminals 6*a*, 6*b*, 6*c* and 6*d* form an integral part of what will be referred to as a timer and terminal-carrying sub-assembly 10 including an insulating support base 11 carrying a timer formed by a heater coil and bimetal blade assembly generally indicated by reference numeral 12**.

Projecting forwardly from the rear wall 5 of the main housing body 2A is a vertical wall 13 which divides the interior of the main housing body into left and right hand buzzer-receiving compartments which are spaced apart in a direction parallel to the plane of the parts-receiving opening of the main housing body, and transversely to the direction in which the various terminals **6*a* through 6*f* project from the main housing body. Supported in these compartments are the buzzer units 14–14' which, for the most part, are mirror-images on one another. (The various details of the buzzer units will be described later on in the specification.) Suffice it to say at this point, the buzzer units 14–14' include coil and armature support plate members 15–15' respectively which are integral with the associated plug-in terminal 6*e*–6*f* and are stamped as one piece from a sheet metal blank. The support plate members 15–15' have vertical legs 15*a*–15*a'* in line with plug-in terminals 6*e*–6*f*, and upper and lower legs 15*b'*–15*c'* (FIG. 10). The upper legs 15*a*–15*a'* of support plate members 15–15' respectively support bobbins 21–21' over which are wound coil windings 20–20'. Also supported on the plate members 15–15' are armature assemblies 22–22' from which project striker members like 22*a*. The striker members are in alignment with inwardly extending projections 25*a*–25*a'* (FIGS. 4 and 8) of the rear wall 5 of the main housing body 2A. When the associated coils 20–20' are alternately energized and de-energized, the armature assemblies 22–22' vibrate forward and backward to strike the rear wall projections 25*a*–25*a'*, respectively. Associated with the armature assemblies 22–22' are respective sets of normally-closed interrupter contacts 24–24' which open when the associated coils 20–20' are energized. The sets of contacts 24–24' include contacts 24*a*–24*a'* which respectively extend from conductive vibratable metal reeds 22*b*–22*b'* which carry the striker members 22*a*–22*a'*. The reeds 22*b*–22*b'* also carry steel armature pieces like 41' (FIG. 11) which are attracted by the energized coils 20–20' to effect vibration of the reeds 22*b*–22*b'*.**

The buzzer units 14–14' are mounted within the main housing body compartments through the parts-receiving opening thereof by tilting each of the units at an angle so that the associated terminals **6*e*–6*f* fit through horizontally and rearwardly facing sections 27*a*–27*a'* (see FIGS. 4 and 5) of terminal-receiving openings 27–27' of the main housing body 2A. The openings 27–27' also have downwardly facing sections 27*b* and 27*b'* through which the terminals 6*e*–6*f* respectively extend after buzzer units are pivoted into a vertical position, where the support plate member apertures 16–16' receive mounting pins 17 and 17' extending forwardly from the rear wall 5 of the main housing body 2A. The shanks of rivets 18–18' are passed through bosses 26–26' on the rear wall 5 and apertures 23–23' in support plate member legs 15*a*–15*a'* of the buzzer units from the rear side of the rear wall 5 of the main housing body and are then peened over the support plate members to anchor the buzzer units in place against front faces of bosses 26–26'**.

As previously indicated, the terminal-carrying subassembly 10 is mounted within the main housing body between the buzzer units 14–14' and the cover 2B. There is formed in the lower portion of the main housing body guideways 26–26' (FIG. 7) opening onto the parts-receiving opening of the main housing body and in which projecting wings **11*a*–11*a'* of the insulating support base 11 of the sub-assembly is slidably mounted. As best shown in FIG. 5, the main housing body bottom wall 3' has a cut-out portion 3*c'* having terminal-receiving sections 35*a*, 35*b*, 35*c* and 35*d* for receiving and confining the terminals 6*a*, 6*b*, 6*c* and 6*d*, respectively as the sub-assembly 10 is pushed into place in the guideways 26–26'. Rearward movement of this sub-assembly is limited by shoulders 28–28' (FIG. 9) formed on the interior of the main housing body. In this position of the sub-assembly, the main wall 29 of the cover 2A engages the front face of the insulating support base 11, which has a forwardly facing projection 11*b* which fits into a corresponding positioning aperture 30 on the inner face of the cover wall 29 which anchors the sub-assembly 10 in place. As best shown in FIG. 8, the cover 2B has rearwardly extending upper and lower walls 33–35 which respectively are positioned contiguous to the forward extensions 3b–3b' of the top and bottom walls 3–3' of the main housing body 2A. Also, the cover wall 29 engages the front end of the wall 13 extending forwardly from the rear wall 5 of the main housing body, which wall 13** thus braces the cover against inward deflection.

The terminals 6a, 6b, 6c, and 6d of the sub-assembly 10 are preferably insert molded within the insulating support base 11. FIG. 12 shows the assembly of the insulating support base 11 with the terminals 6a, 6b, 6c and 6d molded therein as these parts are removed from a mold. In such condition, the terminals 6a, 6b, 6c and 6d, which are stamped from the same piece of sheet metal, are interconnected by webs 37a, 37b and 37c so that the stamping forms a central single integral unit for convenient handling until these webs are severed from the terminals after completion of the insert molding operation. The plug-in terminals 6a, 6b, 6c and 6d merge with terminal extensions 31a, 31b, 31c and 31d of the sheet metal stamping, which extensions project upwardly above the insulating support base 11. The plug-in terminals 6c and 6d also have terminal tabs 31c' and 31d' formed integrally therewith which tabs project above the insulating support base 11.

Terminal extensions 31c–31d are provided with weld projections onto which bimetal blades 32'–34' are respectively welded. These blades are in confronting relationship and have respective confronting contacts 32a'–34a' which normally make contact when these blades are unheated. The blade 34' has an insulated coil 37' wound thereon. The bottom end of the heater coil 37' is connected by a conductor 36' to terminal extension 31b to which conductor 36' is soldered or welded. The upper end of the heater coil is soldered or welded directly to the bimetal blade 34' which electrically connects the upper end of the coil 37' to terminal 6d.

The upper end of the buzzer coil 20' is connected by a conductor 39' extending through an entry aperture 35a of a conductor-guiding and groove 35 formed in the upper wall 3 of the main housing body. This groove has an exit opening 35b on the other side of the forwardly facing partition-forming wall 13, and from which opening the conductor 36' extends downwardly to the terminal tab 31c' to which it is soldered or welded. The bottom end of buzzer coil 20' is connected by a conductor 43' to an extension 42a' of metal contact-carrying arm 42' (FIG. 10). The contact-carrying arm has an interrupter contact 24b' which normally engages the interrupter contact 24a' projecting from the associated reed 22b'. The contact-carrying arm 42' is insulated from the reed 22' by an insulating grommet 44'. A metal rivet 47' has a head portion 47a' bearing against an insulating washer 49' positioned against one of the faces of the leg 15c' of support plate member 15' of the buzzer unit 14'. On the opposite face of this leg 15c' is a metal spacer member 51' which engages the reed 22b', and acts as a member which electrically connects the reed 22b' to the support member leg 15c'. The rivet 47' is peened over the rear face of contact-carrying arm 42' and so holds the assembly of the contact-carrying arm 42', insulating gommet 44', armature reed 22b', spacer member 51', and washer 49' upon the support plate member leg 15c'.

The construction of the buzzer unit 14 shown in FIG. 10 is similar to the buzzer unit 14', except that it is a mirror image thereof, and so the buzzer unit 14 will not now be described in detail. However, the support plate member 15 of buzzer unit 14 is identical to the support plate member 15', except that it is reversed in position. Thus, support plate member 15' has a rearwardly extending flange 15d' (FIG. 9) braced against one side of the housing wall 13, whereas the support plate member 15 has a corresponding flange braced against the other side of the housing wall 13.

One of the ends of the coil 20 of buzzer unit 14 is connected by a conductor 39 which tautly bends around an anchoring tab 38 projecting inwardly from the side wall 4 of the main housing body 2A. The conductor 39 is soldered or welded to the terminal extension 31a of the sub-assembly 10. The other end of coil 20 is connected by a conductor 41 (shown only in FIG. 6) in series with interrupter contacts 24, in turn, connected to plug-in terminal 6e.

As shown in FIG. 6, the various plug-in terminals 6a, 6b, 6c, 6d, 6e and 6f plug into a harness socket having corresponding female terminals 49a, 49b, 49c, 49d, 49e and 49f which are connected by wires to the various circuit points indicated therein. Thus, the plug-in terminal 6a is connected through the socket terminal 49a to a key warning switch 50 which is grounded, and the socket terminal 49e receiving the plug-in terminal 6e is connected through a normally open driver's door switch 52 to the positive terminal of the automobile battery. When the driver's key is left in the ignition switch-receiving aperture, the key warning switch 50 will be closed and when the driver's door is opened the normally-opened door switch 52 will close to energize the buzzer unit 14.

The plug-in terminal 6b is connected through the socket terminal 49b to ground, and the socket terminal 49d associated with the plug-in terminal 6d is connected through an ignition switch 54 to the positive terminal of the automobile battery. Accordingly, when the ignition switch 54 is closed, the heater coil 37' is continuously energized, which will heat the associated bimetal blade 34'. When the bimetal blade 34' is heated to a given control temperature, which will take a number of seconds, it deflects to open contacts 32a'–34a'. (Bimetal blade 32' is a conventional temperature-compensated member.) This disconnects the battery from those portions of the circuit connected in series with these contacts, such as the buzzer coil 20'. The plug-in terminal 6f is connected through socket terminal 49f and a normally-closed seat belt switch 56 to ground. The seat belt switch 56 opens when the seat belt is attached. Thus, when the ignition switch 54 is closed, and the seat belt is not connected, the buzzer coil 20' will become energized until either the seat belt is connected or the bimetal blade 34' deflects, as described. The energization circuit for the buzzer coil thus includes plug-in terminal 6d, bimetal blade 34', contacts 32a'–34a', bimetal blade 32', conductor 39', buzzer coil 20', interrupter contacts 24', plug-in terminal 6f, socket terminal 49f and seat belt switch 56.

The plug-in terminal 6c is connected through socket terminal 49c to a seat belt warning lamp 55, in turn, connected to ground. Thus, when the ignition switch is initially closed, the warning lamp 55 is energized through a circuit including bimetal blade 32', contacts 32a'–34a' and bimetal blade 34'. The warning lamp becomes de-energized when the bimetal blade deflects under the conditions described.

The present invention has thus provided a very compact and easy-to-assemble and install double buzzer assembly which occupies much less space and can be constructed and installed at a much lower cost than two separate buzzer assemblies.

It should be understood that numerous modifications may be made in the most preferred form of the invention described without deviating from the broader aspects of the invention. For example, while the various features of the invention have their most important applications to a double buzzer assembly where a timer is associated with at least one of the buzzers, some aspects thereof are also applicable to electrical devices, like automobile flasher units when two flasher units are supported on the guideway mounted sub-assembly as described. Also, while it is preferred that the rear wall of the main housing body be a sound-vibrating element contacted directly by the vibrating armature assemblies of the buzzer units, a member or members separate from the rear wall of the main housing body and positioned within such body may be vibrated by the armature assemblies of the buzzer units. In such case, the rear housing wall could contain apertures through such sound waves produced by the vibrating armature assemblies may readily pass.

I claim:

1. A multi-input buzzer assembly comprising: a housing assembly including a main housing body having a parts-receiving opening confronted by a cover with said main housing body; first and second buzzer units mounted in said main housing body through said parts-receiving opening; a timer and terminal-carrying sub-assembly mounted through said parts-receiving opening in said main housing body, said sub-assembly including a support base carrying respective terminals exposed to the outside of said main housing body and making separate electrical connection with said buzzer units so that the buzzer units can be independently energized, and a timer including heater means and normally closed switch means in series with one of said buzzer units which open the circuit to said unit after the heater means has been energized for a given period of time.

2. The multi-input buzzer assembly of claim 1 wherein said timer and terminal-carrying sub-assembly is slidably mounted in guideway means opening onto said parts-receiving opening.

3. The multi-input buzzer assembly of claim 1 or 2 wherein said parts-receiving opening is located on one side of the main housing body, said main housing body having a sound emitting wall on the opposite side thereof, said first and second buzzer units are mounted contiguous to said sound emitting wall, and said sound generating armature assembly of each buzzer unit being positioned to strike said sound emitting wall during a portion of the path of movement thereof.

4. The multi-input buzzer assembly of claim 3 wherein said sound emitting wall has separate relatively thin diaphragm-forming portions opposite said sound generating armature assemblies which respectively strike the same.

5. The multi-input buzzer assembly of claim 1 wherein said buzzer units are supported in spaced relation in a given direction parallel to the plane of said parts-receiving opening, said terminals of said sub-assembly projecting through a wall of said main housing body transversely to said direction.

6. The multi-input buzzer assembly of claim 1 or 5 wherein said main housing body has a sound emitting wall on the opposite side thereof from said parts-receiving opening, said first and second buzzer units are mounted contiguous to said sound emitting wall, said sound generating armature assembly of each buzzer unit being positioned to strike said sound emitting wall during a portion of the path of movement thereof, and said timer and terminal-carrying sub-assembly is positioned between said buzzer units and said cover.

7. The multi-input buzzer assembly of claim 6 wherein said heater means and normally closed switch means of said sub-assembly are located in alignment with the associated buzzer unit between said cover and one of the buzzer units.

8. The multi-input buzzer assembly of claim 1 wherein each buzzer unit includes a separate sub-assembly including a metal frame forming part of a magnetic path for a coil of the associated buzzer unit and a mounting support for the armature thereof.

9. A multi-input electrical apparatus comprising: a housing assembly including a main housing body having a parts-receiving opening confronted by a cover removably interlocked with said main housing body; first and second electrical devices mounted in said main housing body through said parts-receiving opening and being in spaced relation in a first direction parallel to the plane of said parts-receiving opening; a terminal-carrying sub-assembly for said devices mounted through said parts-receiving opening in said main housing body in guideway means extending transversely of said plane and opening onto said parts-receiving opening, said sub-assembly including a support base carrying respective terminals exposed to the outside of said main body portion through apertures in said main housing body and extending in a direction transverse to said first direction, and different ones of said terminals making separate electrical connection with said electrical devices, so that the devices can be independently energized.

10. The multi-input electrical apparatus of claim 9 wherein said main housing body has a rear wall opposite said parts-receiving opening, a housing-rigidifying wall extending transversely from said rear wall, and said cover of the housing extending contiguous to the outer end of said housing-rigidifying wall.

11. The multi-input electrical apparatus of claim 9 wherein said terminal-carrying sub-assembly is held in place within said main housing body by said cover.

12. The multi-input electrical apparatus of claim 11 wherein said cover and support base of said sub-assembly have portions which interfit when the cover is interlocked with the main housing body.

13. A multi-input buzzer assembly comprising: a housing assembly including a main housing body having a parts-receiving opening confronted by a cover; first and second buzzer units mounted in said main housing body through said parts-receiving opening and being in spaced relation in a first direction parallel to the plane of said parts-receiving opening; and timer and terminal-carrying sub-assembly for said buzzer units mounted through said parts-receiving opening in said main housing, said sub-assembly being positioned between said buzzer units and said cover, said sub-assembly including a support base carrying respective terminals exposed to the outside of said main housing body through apertures in said main housing body and extending in a direction transverse to said first direction, different ones of said terminals making separate electrical connection with said buzzer units so that the buzzer units can be independently energized, and timer means connected to be energized with one of said buzzer units for opening the circuit of such buzzer unit after a given period of time.

14. The multi-input buzzer assembly of claim 13 wherein said sub-assembly is mounted in guideway means extending transversely of said plane and opening onto said parts-receiving opening and held in place by said cover.

15. The multi-input buzzer assembly of claim 13 wherein said parts-receiving opening is located on one side of the main housing body, said main housing body have a sound emitting wall on the opposite side thereof, said first and second buzzer units are mounted contiguous to said sound emitting wall, and a sound generating armature assembly of each buzzer units is positioned to strike said sound emitting wall during a portion of the path of movement thereof.

16. The multi-input buzzer assembly of claim 15 wherein said sound emitting wall has separate relatively thin diaphragm-forming portions opposite said sound generating armature assemblies which respectively strike the same.

17. The multi-input buzzer assembly of claim 13 wherein said timer means is in alignment with the associated buzzer unit.

18. The multi-input buzzer assembly of claim 13 wherein each buzzer unit includes a separate sub-assembly including a metal frame forming part of the magnetic path for a coil of the associated buzzer unit and a mounting support for an armature assembly thereof.

19. The multi-input buzzer assembly of claim 18 wherein said main housing body has a rear wall opposite said parts-receiving opening, a rigidifying wall extending transversely from said rear wall and separating the interior of the main housing body into separate compartments for holding said respective buzzer units, each of said metal frames of the buzzer units has a flange which extends against said housing-rigidifying wall, and said cover of the housing extends contiguous to the outer end of said housing-rigidifying wall.

20. The multi-input buzzer assembly of claim 13 wherein said main housing body has a rear wall opposite said parts-receiving opening, and there is provided a cover-rigidifying wall extending transversely of said rear wall and dividing the interior of the main housing body into separate compartments in which said buzzer units are respectively mounted.

21. The multi-input buzzer assembly of claim 20 wherein said timer and terminal-carrying sub-assembly extends along one of the margins of both of said compartments, the terminals associated with each buzzer unit being located adjacent to the compartment containing the associated buzzer unit.

22. The multi-input buzzer assembly of claim 21 wherein said timer and terminal-carrying sub-assembly is slidably mounted within guideway means opening onto said parts-receiving opening and is held in place within said main housing body by said cover.

23. The multi-input buzzer assembly of claim 22 wherein said cover and support base of said sub-assembly have parts which interfit when the cover is interlocked with the main body portion of the housing assembly.

24. The multi-input buzzer assembly of claim 18 wherein said buzzer unit sub-assemblies include terminals exposed to the outside of said main housing body and said buzzer unit sub-assembly terminals and said terminals of said timer and terminal-carrying sub-assembly extend in the same direction from the same side of said main housing body to be matable with the same connector.

25. The multi-input buzzer assembly of claim 20 wherein said main housing body has peripheral walls projecting toward said parts-receiving opening thereof, there being a conductor-receiving groove formed in at least one of said peripheral walls which receives a conductor extending from a buzzer unit on one side of said cover-rigidifying wall, said conductor then passing through a clearance opening in said peripheral wall to extend along the side of said housing-rigidifying wall opposite to the side containing the buzzer unit from which it extends.

* * * * *